US005494423A

United States Patent [19]

Ishiyama et al.

[11] Patent Number: 5,494,423

[45] Date of Patent: Feb. 27, 1996

[54] ROTARY COMPRESSOR AND BLADE TIP STRUCTURE

[75] Inventors: Akihiko Ishiyama, Tochigi; Ken'ichi Kawashima, Hitachinaka; Hirokatsu Kohsokabe, Ibaraki; Shoichi Nakashima, Hitachi; Hideki Yazawa, Saitama; Hiroaki Hata, Tochigi; Tadashi Iizuka, Ashikaga; Kazuo Sekigami, Tochigi; Koichi Sato, Utsunomiya, all of Japan

[73] Assignee: Hitachi, Ltd., Tokyo, Japan

[21] Appl. No.: 390,502

[22] Filed: Feb. 17, 1995

[30] Foreign Application Priority Data

Feb. 18, 1994 [JP] Japan ..... 6-021021

[51] Int. Cl.[6] ..... F01C 1/02

[52] U.S. Cl. ..... 418/63; 418/179; 418/243

[58] Field of Search ..... 418/63, 179, 234, 418/243, 244, 247, 248, 249

[56] References Cited

U.S. PATENT DOCUMENTS

| | | | |
|---|---|---|---|
| 1,692,639 | 1/1928 | Elsner | 418/63 |
| 4,615,663 | 10/1986 | Iio et al. | 418/179 |

FOREIGN PATENT DOCUMENTS

| | | | |
|---|---|---|---|
| 1158589 | 1/1989 | Japan . | |
| 2191891 | 7/1990 | Japan | 418/179 |
| 4314988 | 4/1991 | Japan . | |
| 3233187 | 10/1991 | Japan | 418/179 |
| 5306693 | 4/1992 | Japan . | |
| 4314988 | 11/1992 | Japan . | |

*Primary Examiner*—Charles Freay
*Attorney, Agent, or Firm*—Antonelli, Terry, Stout & Kraus

[57] ABSTRACT

A rotary compressor has a compression chamber defined by a rolling piston which is eccentrically rotated in a cylinder by a rotary shaft including an eccentric crank portion, and by a blade which slides in a groove formed in the cylinder and of which the tip contacts an outer-peripheral surface of the rolling piston. In such a rotary compressor, abnormal wear in the contact portion between the rolling piston and the blade can be prevented as follows: Assuming that the rotation angle of the rolling piston when the blade is located at a start position of reciprocating motion is zero degrees, the contact surface of the blade which is in contact with the rolling piston is formed to have a curvature of substantially zero and as a flat surface when the rotation angle of the rolling piston is about 90 degrees and about 270 degrees and the pressing force of the blade with respect to the rolling piston reaches the maximum value; and also, a material which has an elastic modulus lower than that of the material of the rolling piston which is highly self-lubricative is used for the blade.

8 Claims, 8 Drawing Sheets

ROTARY COMPRESSOR AND BLADE TIP STRUCTURE

BACKGROUND OF THE INVENTION

The present invention relates to a rotary compressor used for a refrigerator, an air-conditioner or the like and, more particularly, to the structure of a rolling piston/blade assembly in a rotary compressor, which structure prevents abnormal wear of the rolling piston and the blade so as to provide a highly reliable rotary compressor.

FIGS. 4 and 5 show the cross-sectional structures of a rotary compressor to which the present invention is applied. The rotary compressor, which is denoted by a reference numeral 1 as a whole, comprises a cylindrical hermetic shell 10, and a motor 20 and a compression unit 30 which are received in the hermetic shell 10. The motor 20 includes a stator 22, secured on the inner wall of the hermetic shell 10, and an armature 24. A rotary shaft 26 fixed in the center of the armature 24 is rotatably supported by two bearings 34, 36 which serve as side panels of a compression chamber of the compression unit 30. The rotary shaft 26 includes an eccentric portion referred to as a crank portion 28.

A cylinder member 32 is interposed between the two bearings 34 and 36. The cylinder member 32 has the same axis as the rotary shaft 26. As shown in FIG. 5, an inlet 33 and an outlet 35 for a refrigerant are formed in a peripheral wall of the cylinder 32.

An annular rolling piston 38 is provided in the cylinder 32. An inner peripheral surface **38*b* of the rolling piston 38 fits with an outer peripheral surface 28*a* of the crank portion 28, and an outer peripheral surface 38*a* of the rolling piston 38 contacts with lubricant films on an inner peripheral surface 32*b* of the cylinder 32**.

A blade 40 is slidably mounted in a wall of the cylinder 32, and the tip of the blade 40 abuts against the outer peripheral surface **38*a* of the rolling piston 38. The blade 40 is urged toward the rolling piston 38 by spring 42, and the compressed refrigerant is supplied to the rear surface of the blade 40, thereby ensuring fluid tightness between the tip of the blade 40 and the rolling piston 38**.

The blade 40, the rolling piston 38, the cylinder 32 and the bearings 34, 36 define a space of the compression chamber 50.

When the rotary shaft 26 rotates in a clockwise direction, as viewed in FIG. 5, the rolling piston 38 eccentrically rotates within the cylinder 32 so that the refrigerant fluid introduced from the inlet 33 is compressed and discharged from the outlet 35.

During the suction, compression and discharge process, a pressing force Fv is generated on a contact portion between the rolling piston 38 and the blade 40. Moreover, generally, the rotary shaft 26 and the rolling piston 38 are movably fitted to each other, so that a relative sliding velocity v between the rolling piston 38 and the blade 40 is affected by the balance of the loads and friction forces on these members and a drive force of the rotary shaft 26. FIGS. 6A and 6B respectively show the relationship between the pressing force Fv and the rotation angle of the rotary shaft 26 and between the relative sliding velocity v and the rotation angle of the rotary shaft 26, both during one rotation of the rotary shaft 26.

As shown in FIGS. 6A and 6B, the blade 40 exhibits the maximum value of the pressing force when the rotation angle of the rotary shaft 26 is about 90 degrees and about 270 degrees from a direction of reciprocation of the blade 40 as a reference line. The relative sliding velocity between the rolling piston 38 and the blade 40 changes in its direction and rate during one rotation of the rotary shaft 26 so that it is difficult to form an oil film on the contact portion between the rolling piston 38 and the blade 40.

FIGS. 7A and 7B show the contact portion between the rolling piston 38 and the blade 40 more specifically. Conventionally, a contact surface **40*a* of the tip of the blade 40 in contact with the outer peripheral surface 38*a* of the rolling piston 38 has been formed as an arcuate surface having a radius of curvature Rv. The radius of curvature Rv is substantially equal the a thickness t of the blade 40 and is approximately 1/10 to 1/3 of the radius of the rolling piston 38**.

Mainly, cast iron or alloyed cast iron which has been quenched is used as a material for the rolling piston 38, and stainless steel or tool steel or such steel which has been subjected to surface treatment like nitriding is used as a material for the blade 40. Especially, the blade 40 is usually made of a material having high hardness and high toughness.

As shown in FIG. 8, a contact condition between the rolling piston 38 and the blade 40 can be considered as a problem of contact between cylinders having different curvatures. In this condition, a Hertz stress, i.e., a contact stress a expressed by the following formula is generated on the contact portion between the rolling piston 38 and the blade 40 due to the pressing force Fv of the blade 40.

$$\sigma^2=\{(Fv/L)\cdot(E'/2\ \pi R)\} \quad (1)$$

$$1/E'=(1/2)\cdot\{(1-\upsilon r^2)/Er+(1-\upsilon v^2)/Ev\} \quad (2)$$

$$1/R=1/Rr+1/Rv \quad (3)$$

wherein reference symbol Rr is the radius of the rolling piston 38, Rv: the radius of the tip of the blade, L: the length of contact, Er: the elastic modulus of the material of the rolling piston, Ev: the elastic modulus of the material for the blade, υr: a Poisson's ratio of the rolling piston material, υv: Poisson's ratio for the blade material, and E': an equivalent elastic modulus.

Actually, the above-mentioned contact stress σ between the rolling piston 38 and the blade 40 varies according to the change of the pressing force Fv of the blade during one rotation of the rotary shaft 26. However, if the pressing force Fv of the blade exceeds a certain level, the relative sliding velocity v between the rolling piston 38 and the blade 40 becomes 0, and the Hertz stress concentrates on one portion of the outer periphery of the rolling piston 38 so that this portion will repeatedly receive the stress. In general, fatigue rupture of a metallic material has a characteristic that if the stress exceeds a certain level, then the number of repetitions of the application for stress until fatigue rupture occurs decreases in accordance with the increase of the stress, as indicated by a so-called S-N curved line shown in FIG. 9.

However, no active research has been performed with respect to the above-described problem in the conventional structure of the contact portion between the rolling piston 38 and the blade 40 in a rotary compressor. When a system with a rotary compressor is used in a severe condition, abnormal wear between the rolling piston 38 and the blade 40 may be generated by a mechanism presumed to be as follows, and a deficiency of the cooling capacity may be caused by the following phenomenon:

Rising in an ambient temperature of the refrigeration system → rising in the discharge pressure → increase of the pressing force of the blade → the rolling piston/blade sliding velocity of 0 → repeated concentration of the Hertz stress → occurrence of fatigue wear of the outer periphery of the rolling piston → occurrence of severe wear of the outer periphery of the rolling piston → decrease of the cooling capacity.

For example, Japanese Utility Model Unexamined Publication No. 1-158589 discloses a blade with a tip that is formed of a surface having a plurality of curvatures so as to decrease the Hertz stress generated on the tip of the blade. Also, Japanese Patent Unexamined Publication No. 5-306693 discloses a shape of a blade whose edge is brought into plane contact with a rolling piston when the rolling piston is at such a rotation angle that a high-pressure chamber has the maximum pressure.

Moreover, Japanese Patent Unexamined Publication No. 4-314988 discloses having the hardness of the material of a blade a lower than that of the material of a rolling piston.

SUMMARY OF THE INVENTION

As a result of analysis of movements of a rolling piston and a blade of a rotary compressor, the present invention provides a rotary compressor of high durability.

In order to solve the above-described problem, the following factors must be taken into account.

1. To select shapes and material properties of a rolling piston or a blade so that the Hertz stress expressed by the foregoing formula (1) is as small as possible with respect to the same pressing force of the blade.
2. To suitably select material properties of the rolling piston and the blade and a hardness difference between them, so that when abnormal stress concentration on a contact portion between the rolling piston and the blade occurs, the blade is mainly caused to wear, to thereby suppress a decrease of the cooling capacity, so that wear particles generated then are prevented from affecting the system unfavorably.

Taking the above factors into consideration, the present invention includes the following, especially concerning the shape and material properties of a blade.

a. A curved surface having a radius which is at least larger than the a radius of a rolling piston, or a flat surface (curvature 0=radius ∞), is formed on the tip of the blade in a contact portion between the rolling piston and the blade, especially in the vicinity of the position of contact between the rolling piston and the blade where the maximum value of the pressing force is exhibited, and also, concerning properties of materials of the rolling piston and the blade, the materials are selected in such a manner that the elastic modulus of the blade material is lower than that of the rolling piston material.
b. Concerning the hardness difference between the rolling piston and the blade, the materials are selected in such a manner that the hardness of the blade material is lower than that of the rolling piston material.
c. In selecting the blade material, a sliding material of non-ferrous metal or non-metal which has a uniform composition is used as the blade material. Further, a solid lubricant may be added to this blade material.

The above-described structure enables the following function.

According to the foregoing formula (1), in order to reduce the contact stress when the pressing forces of the blade are the same, it is effective to increase the equivalent radius R or to decrease the equivalent elastic modulus E'.

For the purpose of increasing the equivalent radius R, there can be suggested a method of increasing either the radius Rr of the rolling piston or the radius Rv of the tip of the blade,. Since the radius of the rolling piston is determined by the required cooling capacity of the compressor and the size of the cylinder, it is preferred to change the radius Rv of the blade tip. For example, assuming that the ratio of the radii of the rolling piston and the blade tip Rr:Rv, which has conventionally been about 5:1, is set at 5:5 (1:1), and that the other material properties are the same, the contact stress is calculated by use of the formulas (1) and (2). As a result, the contact stress is decreased by about 40%. Further, when a flat surface is formed on a contact portion of the blade, the radius ratio becomes 5:∞, and the contact stress is decreased by about 60%.

In order to decrease the equivalent elastic modulus E', there can be suggested decreasing either the elastic modulus Er of the rolling piston or the elastic modulus Ev of the blade in the formula (2). For example, assuming that the ratio Er:Ev is about 3:1 although the representative value of this ratio of the conventional combination of materials has been about 3:5, the contact stress is decreased by about 40%.

The above-described function enables the decrease of the contact stress between the rolling piston and the blade. However, by making the hardness of the blade lower than that of the rolling piston, wear of the blade is made relatively larger even if stress concentration occurs, thereby preventing the cooling capacity from decreasing. Moreover, by using a highly self-lubricative material of a uniform composition for the blade, damage on the surface of the rolling piston due to wear particles can be prevented, thus stopping severe wear. Needless to say, the amount of wear of the blade can be appropriately reduced to the minimum by a method such as adding a solid lubricant to the blade material.

DETAILED DESCRIPTION OF THE PREFERRED EMBODIMENTS

Figure 1A:
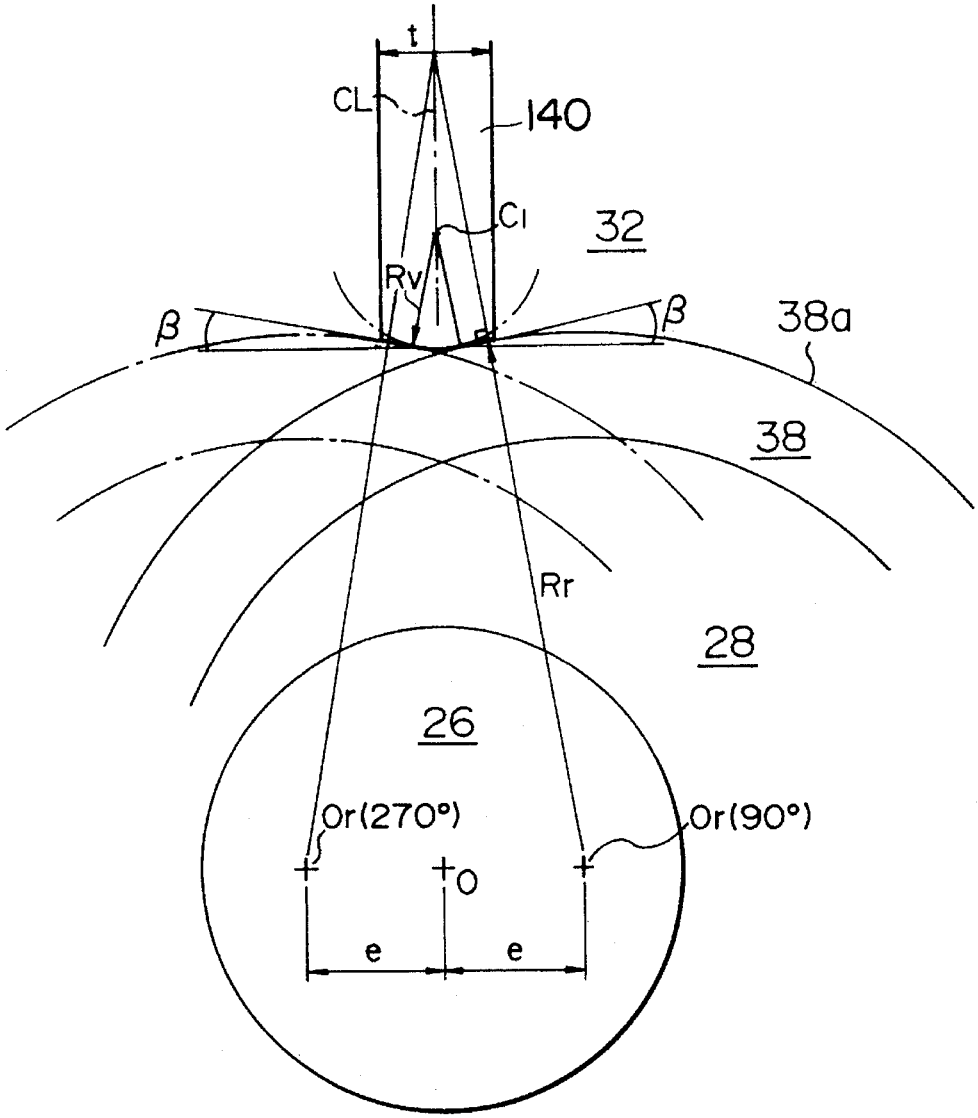
FIGS. 1A and 1B are schematic diagrams showing a contact condition between a rolling piston and a blade in a first embodiment according to the present invention.
Figure 1B:
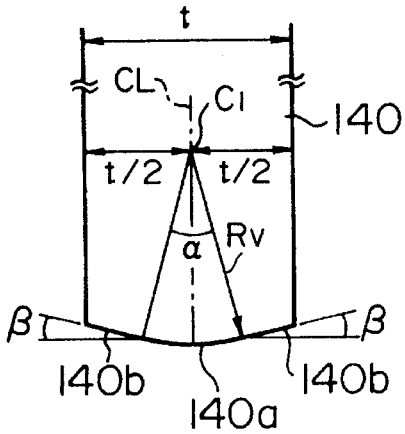
Figure 7A:
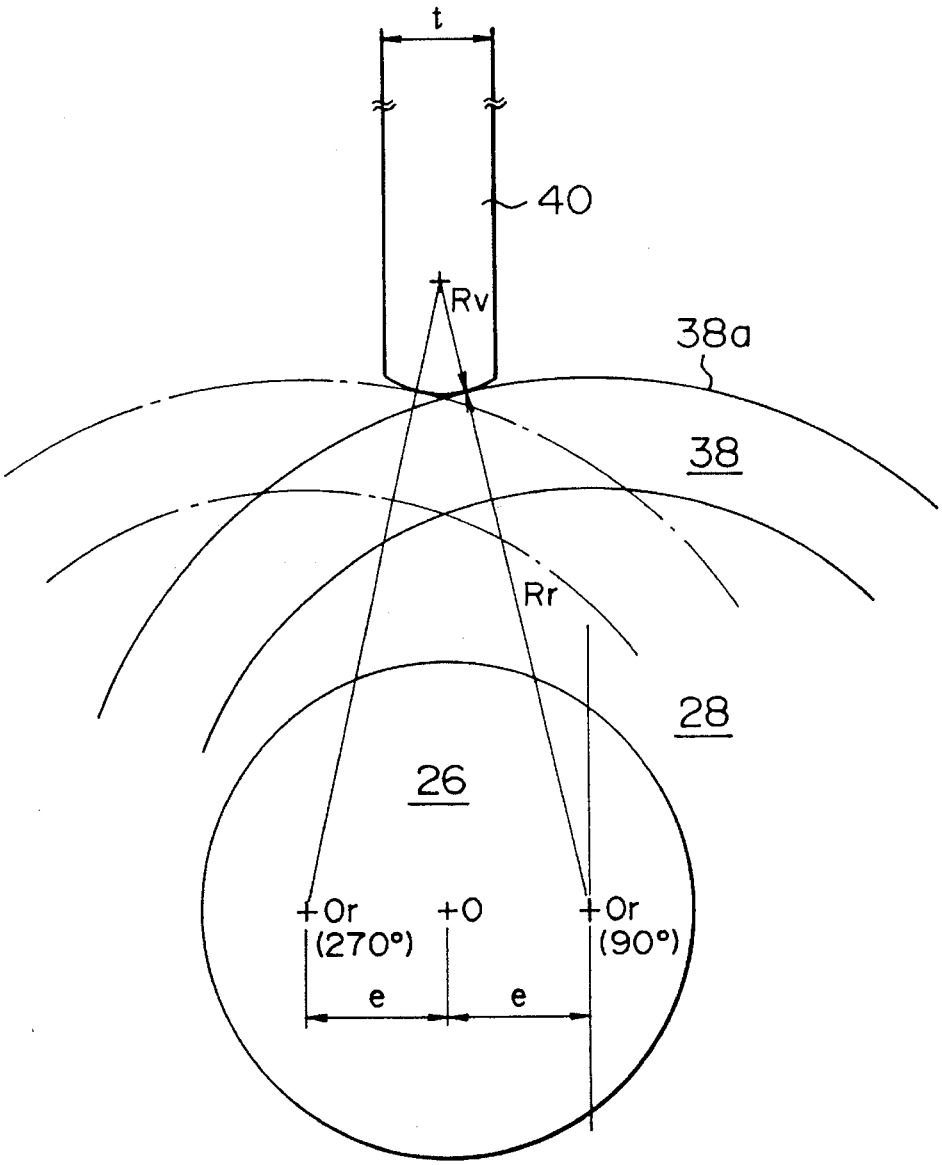
FIG. 7A PRIOR ART
FIGS. 7A and 7B are schematic diagrams showing a contact condition between a rolling piston and a blade in the conventional technology.
Figure 7B:
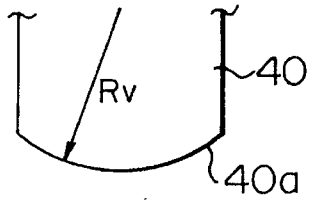
FIG. 7B PRIOR ART
Figure 8:
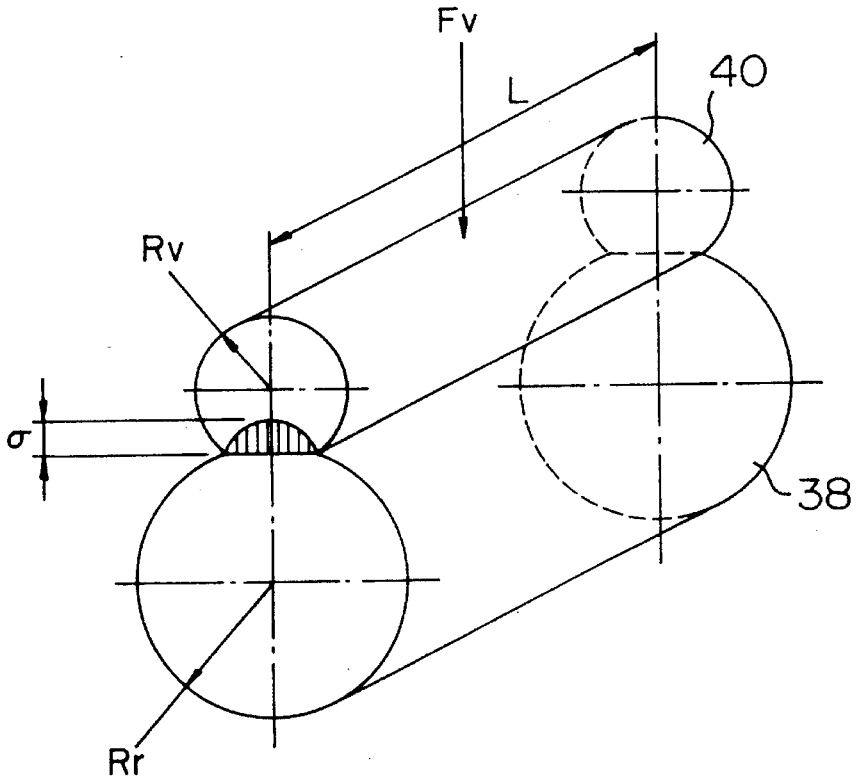
FIG. 8 is a schematic diagram showing a contact condition between modeled cylinders which represent the rolling piston and the blade.
Figure 9:
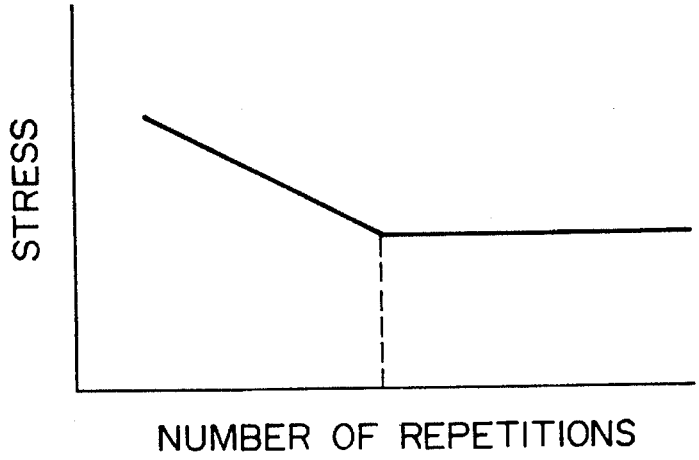
FIG. 9 is a conceptual graph showing an S-N curved line of a metallic material.

A rotary compressor shown in FIGS. 1A and 1B is a first embodiment according to the present invention, and in the same manner as the conventional rotary compressor shown in FIGS. 7A and 7B, an outer peripheral surface 38*a* of a rolling piston 38 has a radius Rr, which rolling piston 38 is provided on an outer-peripheral portion of a crank portion 28 of a rotary shaft 26, and a blade 140, of which the tip is in contact with the outer peripheral surface 38*a* of the rolling piston 38, has a thickness t.

The eccentricity of the axis Or of the annular rolling piston 38 from the axis O of the rotary shaft 26 is expressed as a distance e, and the annular position of the rotary shaft 26 when the line connecting the axis O of the rotary shaft 26 with the axis Or of the rolling piston 38 aligns with the centerline CL of the blade 140 is supposed to be 0 degrees. In this case, the positional relations between the rolling piston 38 and the blade 140 when the rotary shaft 26 is at 90 degrees and 270 degrees are shown in FIG. 1A.

FIG. 1B is an enlarged view showing the shape of the tip of the blade 140. A central portion 140*a* of the tip of the blade 140 is formed as an arcuate surface having a radius Rv, the center of which is a point $C_1$ on the center line of the thickness t of the blade 140.

The radius of curvature Rv of the first contact surface 140*a* which is such an arcuate surface is determined to be about ⅕ of the radius Rr of the rolling piston 38.

The first contact surface 140*a* is formed over an angle α around the centerline CL. Second contact surfaces 140*b* on the outer sides of the first contact surface 140*a* are formed to have a curvature smaller than that of the outer-peripheral surface 38*a* of the rolling piston 38 (1/Rr). The curvature of the second contact surfaces 140*b* may be zero.

The second surfaces 140*b* are located in such areas as to abut against the outer-peripheral surface 38*a* of the rolling piston 38 while the rotation angle of the rotary shaft 26 is approximately in a range from 60 degrees to 120 degrees and a range from 240 degrees to 300 degrees.

More specifically, reference symbol β denotes an angle defined between an imaginary plane perpendicular to the centerline CL of the blade 140 and each of the second surfaces 140*b* which is a flat surface, Rv denotes the radius of the curved surface 140*a* of the blade tip, Rr denotes the radius of the rolling piston 38, ev denotes an offset distance of the center position of the radius Rv of the blade tip from the centerline CL, e denotes the eccentricity of the center position of the rolling piston 38 from the center position O of the rotary shaft 26, and t denotes the blade thickness. In this case, if the following relationship is established, the rolling piston 38 and the flat portions 140B of the blade 140 can abut against each other at least when the rotation angle of the rotary shaft 26 is about 90 degrees and about 270 degrees from the reciprocating direction of the blade 140 as a reference line:

$$\sin \beta \leqq (e+ev)/(Rr+Rv)$$

Next, in order to decrease the equivalent elastic modulus E', either the elastic modulus Er of the rolling piston 38 or the elastic modulus Ev of the blade 140 is decreased in the formula (2). For instance, although a representative value of Er:Ev of the conventional combination of materials is about 3:5, a value of Er:Ev is set at about 3:1 so that the contact stress can be accordingly reduced by about 40%.

Owing to the above-described function, the contact stress between the rolling piston and the blade can be decreased. However, the hardness of the blade is made lower than that of the rolling piston, so that even if stress concentration occurs, wear on the blade side is relatively larger, thereby preventing decrease of the cooling capacity. Moreover, by using a highly self-lubricative material of a uniform composition for the blade, damage on the surface of the rolling piston due to wear particles can be prevented, thus stopping severe wear. Needless to say, the amount of wear of the blade can be appropriately reduced to the minimum by a method such as adding a solid lubricant to the blade material.

As the solid lubricant, for instance, molybdenum disulfide is used.

Even if conventional materials are used for the rolling piston and the blade, the Hertz stress on the contact portion can be decreased by 60% as compared with the conventional rotary compressor over about 30% of one rotation. Further, in this embodiment, the rolling piston is made of cast iron similar to the conventional material, and the blade is made of carbon aluminum complex instead of the conventional tool steel, so that the ratio of elastic modulus of the rolling piston material and the blade material Er:Ev which has been 3:5 can be set at about 3:1, thereby decreasing the Hertz stress by about 40%. In consequence, the Hertz stress .can be decreased by about 70%.

Figure 2A:
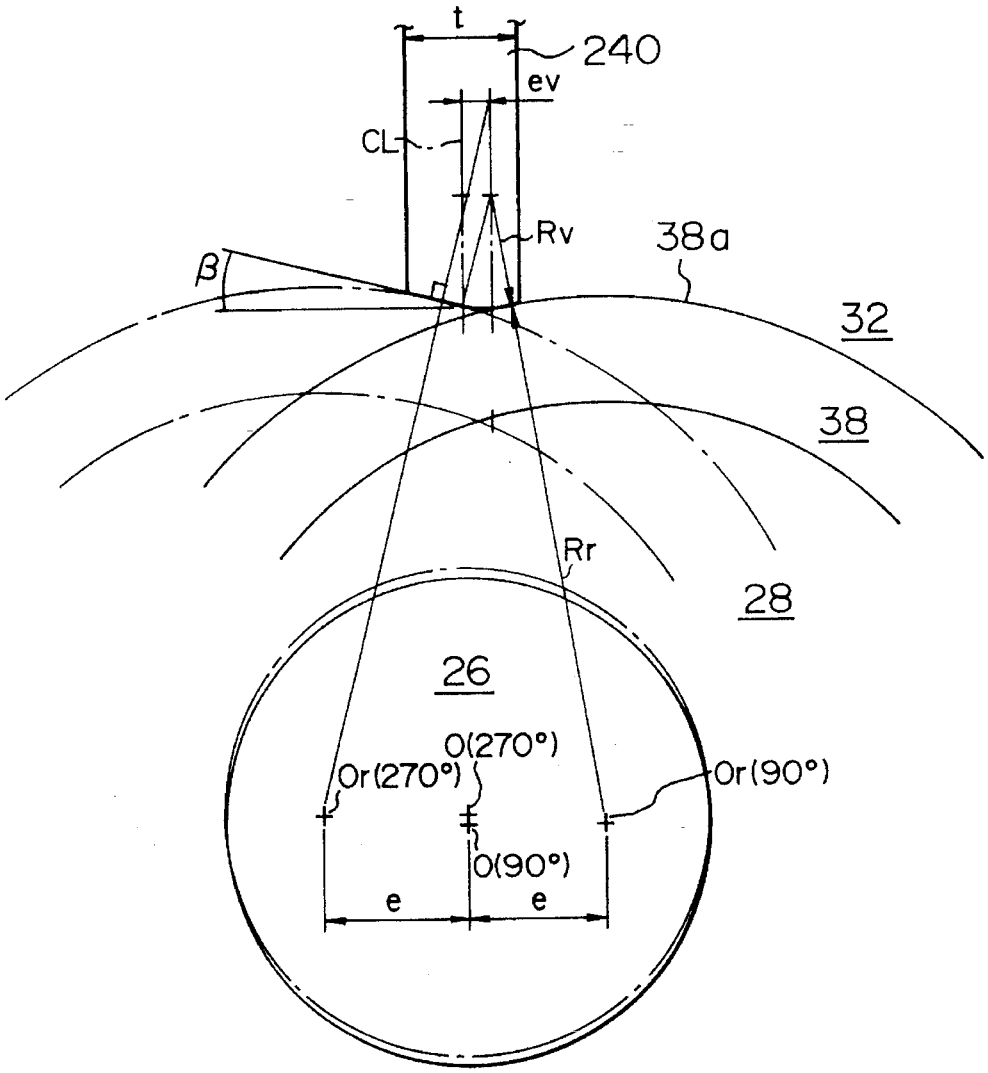
FIGS. 2A and 2B are schematic diagrams showing a contact condition between a rolling piston and a blade in a second embodiment according to the invention.
Figure 2B:
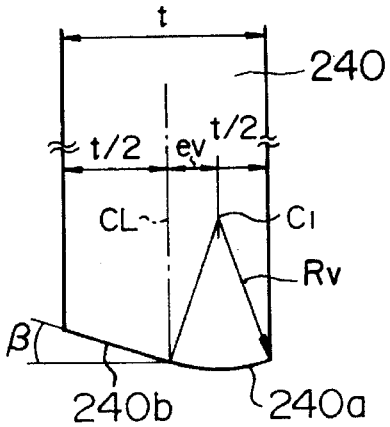

FIGS. 2A and 2B shows a second embodiment according to the present invention.

A rotary compressor of this embodiment is also arranged in such a manner that the rotational axis of the rotary shaft 26 aligns with the centerline CL of a blade 240. The surface of the tip of the blade 240 in contact with the outer peripheral surface 38*a* of the rolling piston 38 consists of a first contact surface 240*a* and a second contact surface 240*b*.

The first contact surface 240*a* is formed as an arcuate surface having a radius Rv from a center $C_1$, and the center $C_1$ is located at a position offset from the center line CL of the blade 240 by a distance ev.

The radius of curvature Rv of the first contact surface 240*a* is determined to be about ⅕ of a radius Rr of the outer-peripheral surface 38*a* of the rolling piston 38.

The second contact surface 240*b* is formed as an arcuate surface having a radius larger than the radius Rr of the outer-peripheral surface 38*a* of the rolling piston 38 or as a flat surface.

The center $C_1$ of the first contact surface 240*a* is offset from the center line CL of the blade 240 in such a direction that the rotation angle of the center Or of the rolling piston 38 is 90 degrees.

The outer-peripheral surface 38*a* of the rolling piston 38 abuts against the flat surface 240*b* of the blade 240 in an area when the rotation angle is about 250 degrees to 290 degrees and the pressing force of the blade is about to reach the maximum value. In this area, the invented shapes take effects in decreasing the Hertz stress by about 60%. Moreover, by using the above-mentioned carbon aluminum complex, the Hertz stress can be totally decreased by about 70%.

Figure 3A:
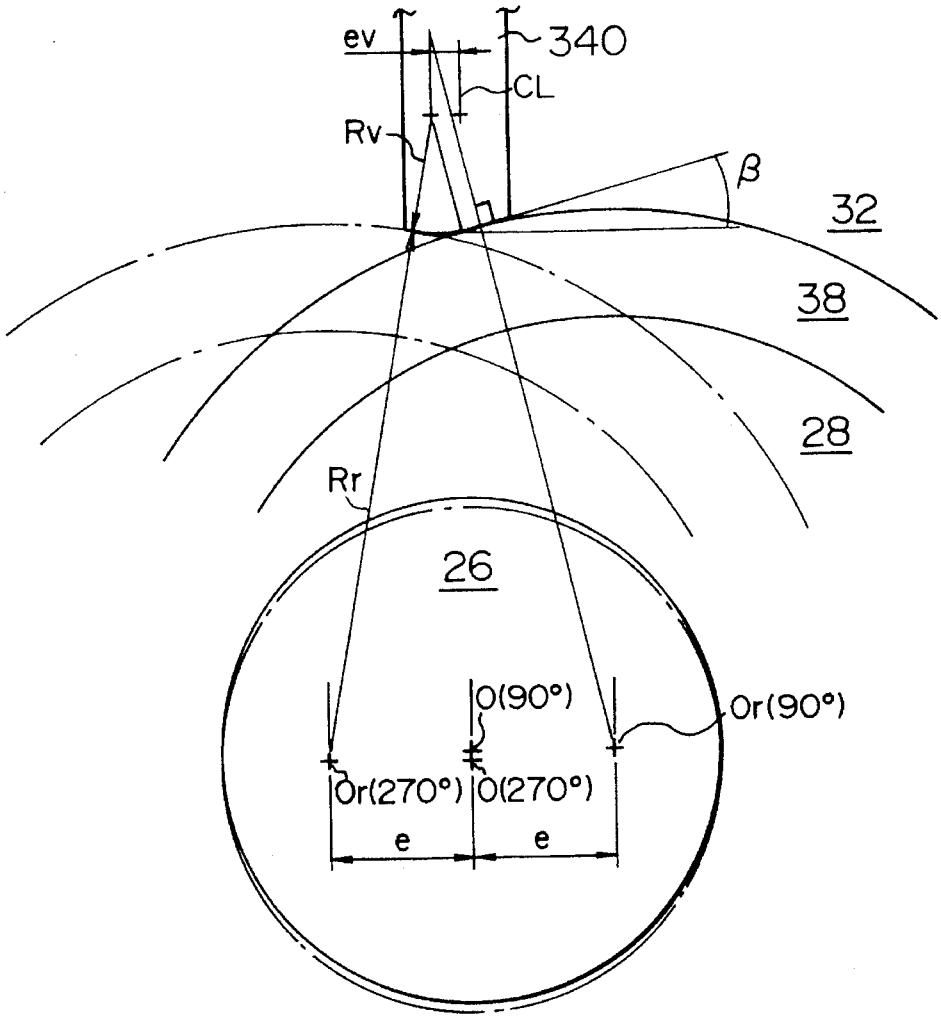
FIGS. 3A and 3B are schematic diagrams showing a contact condition between a rolling piston and a blade in a third embodiment according to the invention.
Figure 3B:
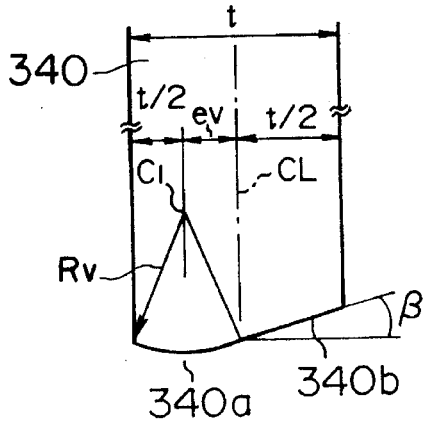
Figure 4:
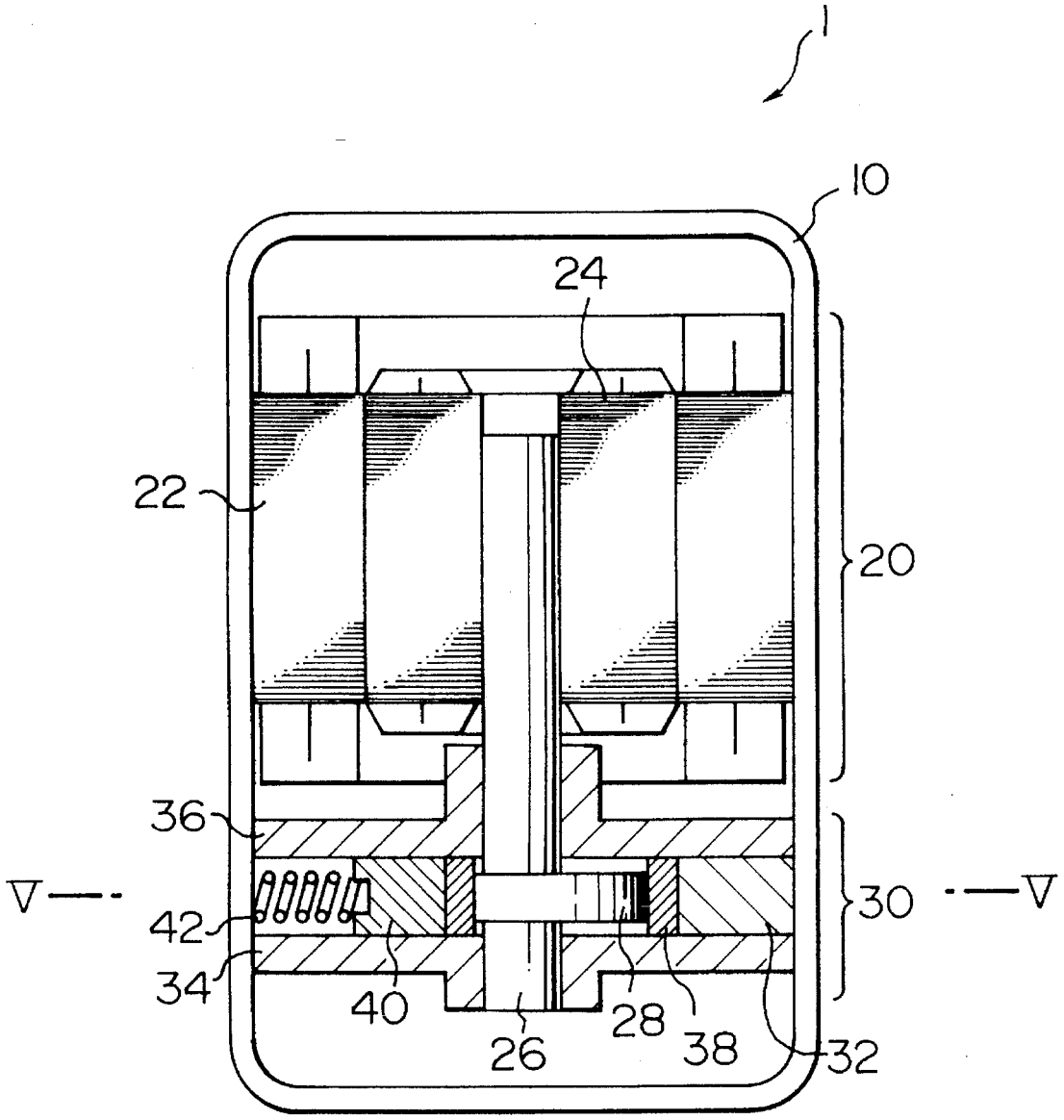
FIG. 4 is a schematic diagram showing a rotary compressor in cross section, taken along the line IV—IV in FIG. 5.
Figure 5:
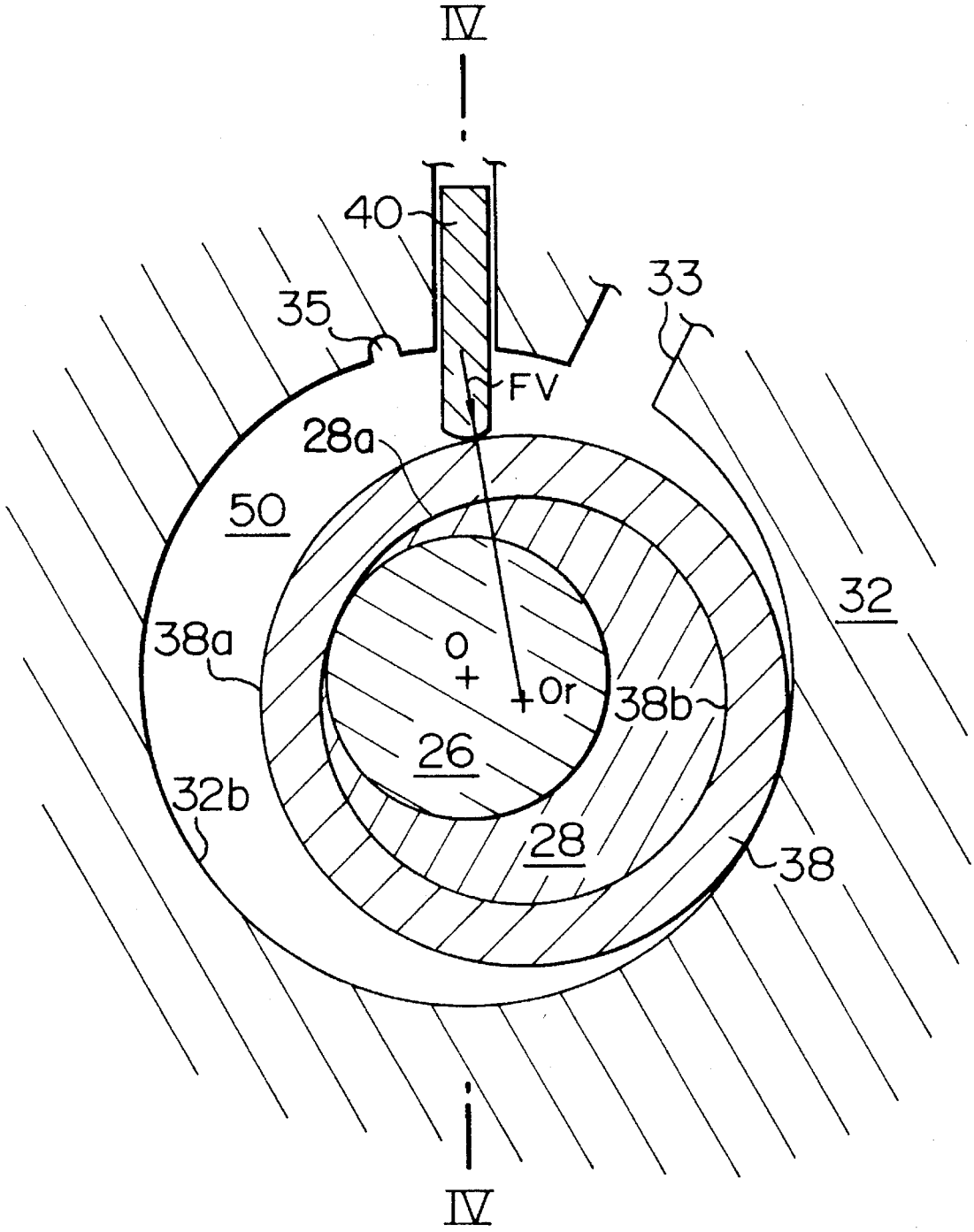
FIG. 5 is a schematic diagram showing compression elements of the rotary compressor in cross section, taken along the line V—V in FIG. 4.
Figure 6A:
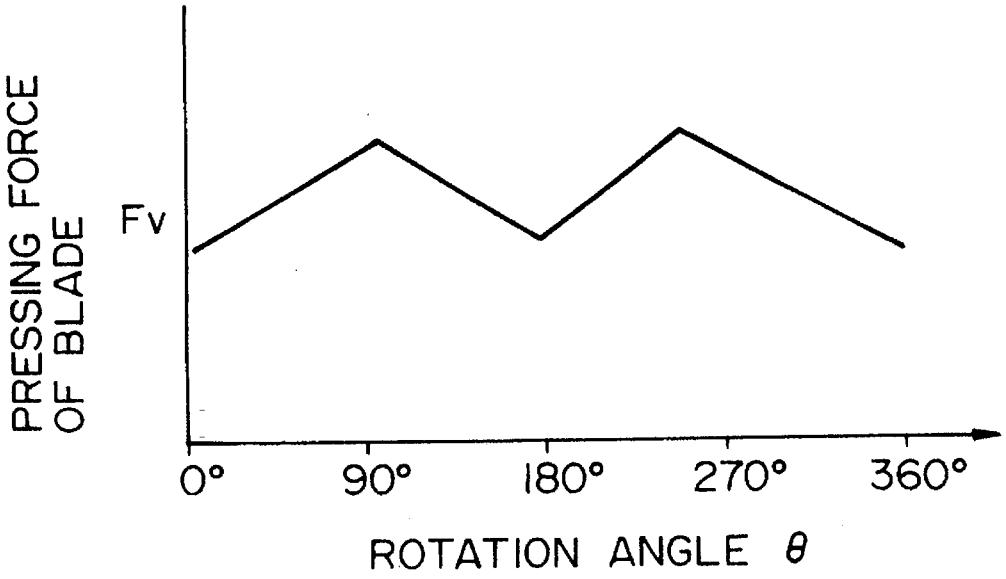
FIGS. 6A and 6B are diagrams respectively showing the relationship between the rotation angle and the pressing force of between the rotation angle and the blade and a sliding velocity between a rolling piston and the blade, both in accordance with the rotation of the rotary shaft.
Figure 6B:
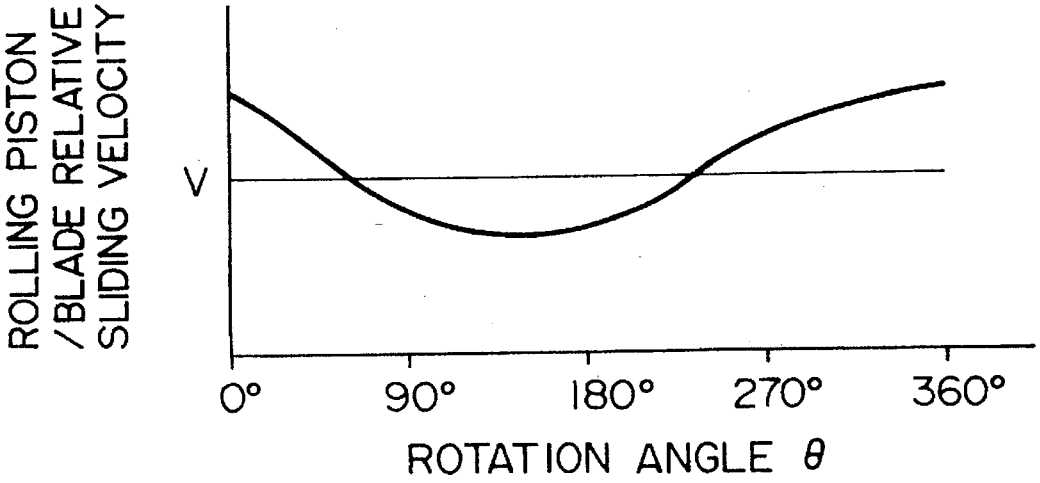

FIGS. 3A and 3B show a third embodiment according to the invention in which the radius center of a curved surface portion of the tip of the blade 340 is located at an offset position in a direction reverse to that shown in FIGS. 2A and 2B.

A rotary compressor of this embodiment is also arranged in such a manner that the rotational axis of the rotary shaft 26 aligns with the center line CL of the blade 340. The surface of the tip of the blade 340 in contact with an outer-peripheral surface 38*a* of a rolling piston 38 consists of a first contact surface 340*a* and a second contact surface 340*b*.

The first contact surface 340*a* is formed as an arcuate surface having a radius Rv from a center $C_1$, and the center $C_1$ is located at a position offset from the centerline CL of the blade 340 by a distance ev.

The radius of curvature Rv of the first contact surface 340*a* is determined to be about ⅕ of a radius Rr of the outer-peripheral surface 38*a* of the rolling piston 38.

The second contact surface 340*b* is formed as an arcuate surface having a radius larger than the radius Rr of the outer-peripheral surface 38*a* of the rolling piston 38 or as a flat surface.

The center $C_1$ of the first contact surface 340*a* is offset from the centerline CL of the blade 340 in such a direction that the rotation angle of the center Or of the rolling piston 38 is 270 degrees.

The outer periphery of the rolling piston 38 abuts against the flat portion 340*b* of the blade 340 in an area where the rotation angle is about 70 degrees to 110 degrees and in the vicinity of the place where the pressing force of the blade is about to reach the maximum value. The effect of decreasing the Hertz stress according to this embodiment is substantially the same as the embodiment shown in FIGS. 2A and 2B.

According to the present invention, as has been described heretofore, the movements of the rotor and the blade in the rotary compressor are analyzed, and the factors which induce wear and damage of the blade are quantified. On the basis of this quantification, the shape of the blade tip is specified, and also, materials of the blade and the rotor are selected, thereby obtaining a highly reliable rotary compressor.

What is claimed is:

1. A rotary compressor comprising a cylinder having a groove therein and having an inlet and an outlet; a rotary shaft extending coaxially with said cylinder and including a crank portion; an eccentrically rotatable rolling piston interposed between said crank portion and said cylinder; and a blade reciprocatingly movable in the cylinder groove, a tip of said blade contacting the outer peripheral surface of said rolling piston, wherein:

when a home position a which said blade starts reciprocating motion toward said rolling piston is determined as a reference of a rotation angle of said rolling piston, the curvature of a surface of said blade which is in contact with said rolling piston is substantially zero when the rotation angle of said rolling piston is one of about 90 degrees and about 270 degrees, the elastic modulus of the material of said blade is equal to or less than the elastic modulus of the material of said rolling piston; and an angle β defined between a plane perpendicular to the direction of the reciprocating motion of said blade and the surface of the blade tip where the curvature is substantially zero establishes the relationship:

$$\sin \beta \leqq (e+ev)/(Rr+Rv),$$

where Rr is the radius of said rolling piston, Rv is the radius of the curved surface portion of the tip of said blade, e is the eccentricity of the axis of said rolling piston from the rotational axis of said rotary shaft, and ev is the offset distance of the center of the radius Rv of said blade tip from the inner-diameter centerline of said cylinder in the direction of the reciprocating motion of said blade.

2. A rotary compressor according to claim 1, wherein the surface hardness of said blade is lower than the surface hardness of said rolling piston.

3. A rotary compressor according to claim 2, wherein said blade is made of a sliding material of one of non-ferrous metal and non-metal which has a uniform composition.

4. A rotary compressor according to claim 3, wherein the material of said blade includes a solid lubricant.

5. A rotary compressor according to claim 4, wherein said solid lubricant is molybdenum disulfide.

6. A rotary compressor according to claim 2, wherein said blade is made of a carbon aluminum complex.

7. A rotary compressor according to claim 3, wherein the material of said blade includes a solid lubricant.

8. A rotary compressor according to claim 7, wherein said solid lubricant is molybdenum disulfide.

* * * * *